US005194352A

United States Patent [19]

Obata

[11] Patent Number: 5,194,352

[45] Date of Patent: Mar. 16, 1993

[54] METHOD FOR TONER DEVELOPMENT OF ELECTROSTATIC LATENT IMAGE AND FOR FORMATION OF TONER IMAGE IN WHICH A SPECIFIED GAP IS MAINTAINED BETWEEN A PHOTOSENSITIVE MEMBER AND AN ELECTROSTATIC INFORMATION RECORDING MEDIUM

[75] Inventor: Hiroyuki Obata, Tokyo, Japan

[73] Assignee: Dai Nippon Printing Co., Ltd., Tokyo, Japan

[21] Appl. No.: 494,357

[22] Filed: Mar. 16, 1990

[30] Foreign Application Priority Data

Mar. 17, 1989 [JP] Japan ..... 1-65468

[51] Int. Cl.[5] ..... G03G 13/044

[52] U.S. Cl. ..... 430/48; 430/102

[58] Field of Search ..... 430/48, 102

[56] References Cited

U.S. PATENT DOCUMENTS

| | | | |
|---|---|---|---|
| 3,666,458 | 5/1972 | Arneth | 430/48 |
| 3,926,627 | 12/1975 | Iwasa | 430/102 |
| 3,953,206 | 4/1976 | Weigl | 430/102 |
| 3,963,488 | 6/1976 | Brushenko | 430/48 |
| 3,972,716 | 8/1976 | Pressman | 430/48 |
| 3,980,475 | 9/1976 | Quang et al. | 430/48 |
| 4,023,895 | 5/1977 | O'Brien | 430/48 |
| 4,868,075 | 9/1989 | Gilgore | 430/102 |

FOREIGN PATENT DOCUMENTS

| | | | |
|---|---|---|---|
| 63-121592 | 11/1989 | Japan | 430/48 |

*Primary Examiner*—Marion E. McCamish
*Assistant Examiner*—Christopher D. RoDee
*Attorney, Agent, or Firm*—Armstrong, Westerman, Hattori, McLeland & Naughton

[57] ABSTRACT

According to the present invention, the photosensitive member and the electrostatic information recording medium are immersed in the toner after image exposure is performed, and the electric field is formed in the gap by short-circuiting between the electrodes of the photosensitive member and the electrostatic information recording medium. Also, bias voltage is applied between the electrodes of the photosensitive member and the electrostatic information recording medium, and the surfaces of the electrostatic information recording medium and the photosensitive member are immersed in the toner. Bias voltage is set to higher than the potential on the unexposed portion and lower than the maximum potential of the exposed portion on the electrostatic information recording medium or the photosensitive member, and toner development of electrostatic latent image is performed with high fidelity on the photosensitive member to form positive or negative image.

6 Claims, 5 Drawing Sheets

METHOD FOR TONER DEVELOPMENT OF ELECTROSTATIC LATENT IMAGE AND FOR FORMATION OF TONER IMAGE IN WHICH A SPECIFIED GAP IS MAINTAINED BETWEEN A PHOTOSENSITIVE MEMBER AND AN ELECTROSTATIC INFORMATION RECORDING MEDIUM

BACKGROUND OF THE INVENTION

The present invention relates to a method for toner development of an electrostatic latent image, which is formed on a photosensitive member and/or an electrostatic information recording medium by performing image exposure using the photosensitive member and the electrostatic information recording medium, and also to the method to form the image using said development method.

Conventionally, high resolution photographing techniques have been practiced, utilizing a silver halide photographic method, an electrophotography technique, a television technique, a solid state image sensor (such as CCD), etc. However, these methods are disadvantageous in that, when image recording is of high quality and high resolution, the treatment process is more complicated, and when the process is simple, the memory function is lacking or the image quality is basically inferior.

The present applicant has already proposed a method to form an electrostatic latent image on an electrostatic information recording medium by exposure under voltage application (Japanese Patent Application No. 63-121592), by which it is possible to record the image with high quality and at high resolution for a long time through simple process and to repeatedly record and reproduce the memorized characters, line drawings, images and code (1,0) information as desired with the image quality suitable for each purpose.

With the electrostatic latent image by the exposure under voltage application, it is possible to obtain an analog recording of very high resolution, whereas the technique to turn it to a visible image with high fidelity is very difficult, and there has been a strong demand for a method to develop the electrostatic latent image in an easier manner and with high fidelity.

SUMMARY OF THE INVENTION

Under such circumstances, it is an object of this invention to offer a method for toner development of electrostatic latent image, by which it is possible to develop the electrostatic latent image, formed by image exposure, to a visible image with high fidelity.

To attain such object, the present invention is characterized in that a photosensitive member consisting of a photoconductive layer formed on a support member with a conductive layer therebetween is placed face-to-face to an electrostatic information recording medium consisting of an insulating layer formed on a support member with a conductive layer therebetween, that voltage is applied between the conductive layers of the photosensitive member and the electrostatic information recording medium and image exposure is performed to accumulate electric charge in the shape of image on the surface of the electrostatic information recording medium, and that at least the surfaces of the electrostatic information recording medium and the photosensitive member are immersed in the toner by short-circuiting or by applying bias voltage between the conductive layers of the photosensitive member and the electrostatic information recording medium and toner development is performed. According to this invention, the photosensitive member and the electrostatic information recording medium are immersed in the toner after image exposure is performed, and an electric field by the accumulated electric charge on the electrostatic information recording medium is formed in the gap by short-circuiting between the electrodes of the photosensitive member and the electrostatic information recording medium. Thus, it is possible to perform the toner development of the electrostatic latent image with high fidelity. By applying bias voltage between the electrodes of the photosensitive member and the electrostatic information recording medium and by setting the potential slightly higher than the potential of the unexposed portion, the toner development by background can be prevented, and a sharp image without photographic fog can be obtained.

Also, by setting the bias voltage approximately to the maximum value of the potential of the exposed portion and by using the toner with the same polarity as the accumulated electric charge, a positive image can be obtained. Because the electric charge generated by discharge is accumulated on the surface of the photosensitive member, a negative image can be obtained by the toner development of such electric charge.

Further, by laminating a color filter on the support member of the photosensitive member, and either by image exposure and toner development or by laminating the insulating color filter on the electrostatic information recording medium, by performing image exposure from the direction of the electrostatic information recording medium and toner development, and by observing it under white light, it is possible to obtain a color image by a single-acting operation.

DETAILED DESCRIPTION OF THE PREFERRED EMBODIMENTS

In the following, the features of this invention will be described on the embodiments in connection with the drawings.

Figure 1A:
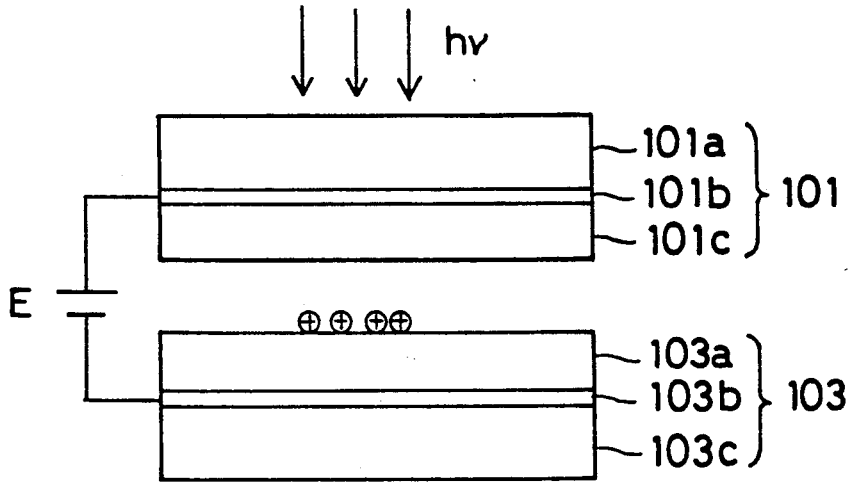
FIG. 1(*a*, *b*, and *c*) shows an embodiment of the toner development method using an electrostatic latent image according to this invention.
Figure 1B:
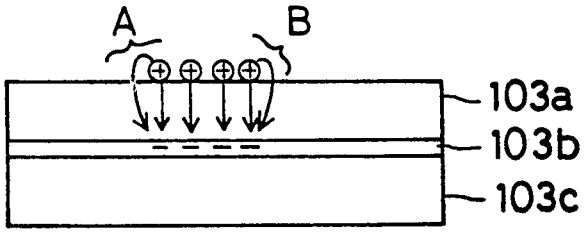
Figure 1C:
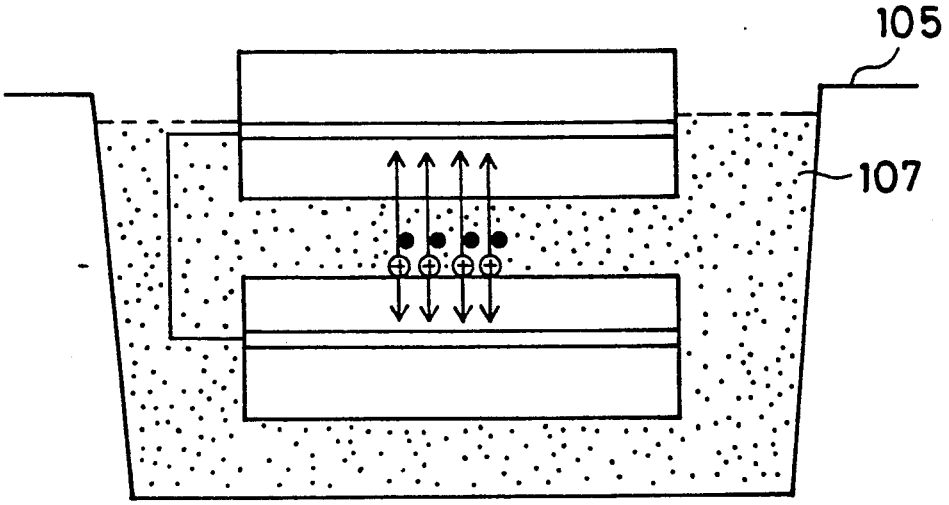

FIG. 1 shows an embodiment of the toner development method using an electrostatic latent image of this invention. In the figure, 101 is a photosensitive member, 101*a* a transparent support member, 101*b* a transparent electrode, 101*c* a photoconductive layer, 103 an electrostatic information recording medium, 103*a* an insulating layer, 105 a container, and 107 toner.

Figure 8:
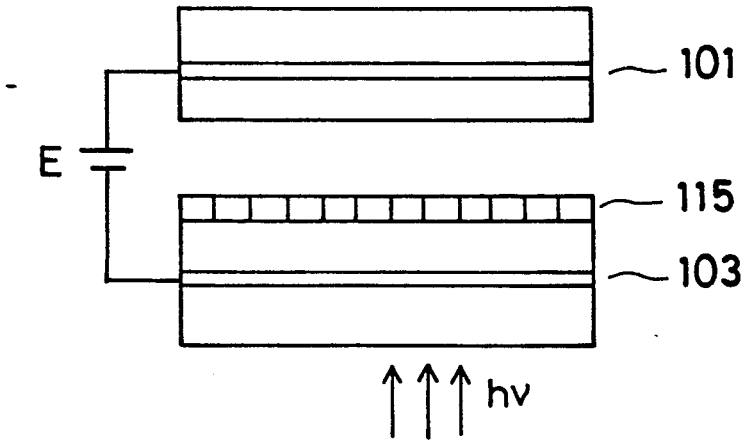
FIG. 8 and FIG. 9(*a*, *b* and *c*)are the drawings of the examples to form color images on the electrostatic information recording medium.

In FIG. 1, exposure is performed from the direction of the photosensitive member 101. First, a transparent photosensitive member electrode 101*b* made of ITO with thickness of 1000 Å is formed on a photoconductive layer support substrate 101*a* made of glass with thickness of 1 mm. Further, a photoconductive layer 101*c* of about 20 μm is formed on it to make up a photosensitive member. To this photosensitive member 101, the electrostatic information recording medium 103 is disposed with a gap of about 10 μm. The electrostatic information recording medium 103 consists of an insulating layer support substrate 103*c* made of glass with thickness of 1 mm, and an aluminum electrode 103*b* with thickness of 1000 Å is vacuum-deposited on it because the electrode does not have to be transparent when exposure is performed from the direction of the photosensitive member as shown in FIG. 1 (*a*). In case exposure is performed from the direction of the electrostatic information recording medium as shown in FIG. 8, a transparent electrode 103*b* made of ITO with thickness of 1000 Å is formed because the electrode must be transparent, and the insulating layer 103*a* with thickness of 10 μm is formed on this electrode 103*b*.

In the arrangement as described above, when image exposure is performed from the direction of the photosensitive member with a voltage of several hundreds of volts applied from the power source E between the photosensitive member 101 and the electrostatic information recording medium 103, the portion of the photoconductive layer 101*c* exposed to the light is turned electrically conductive. A strong electric field is generated in the gap with the electrostatic information recording medium, and corona discharge occurs. As the result, the electric charge corresponding to the image is accumulated on the insulating layer 103*a* of the electrostatic information recording medium, and electrostatic latent image is formed. Because an electrostatic latent image by a positive (+) electric charge is formed in the case of FIG. 1 (*a*), the image can be turned into a visible image through the development by the toner with a negative (−) polarity.

When electric charge is accumulated on the insulating layer 103*a* as given in FIG. 1 (*b*), the electric charge of reverse polarity is induced on the electrode 103*b*, and the lines of electric force from the accumulated electric charge on the electrostatic information recording medium is mainly generated toward the electrode. Accordingly, there are few lines of electric force running outward, and many lines of electric force leak toward the outside at the edge portion of the accumulated electric charge pattern.

When development is performed by a negative (−) toner in the condition as given in FIG. 1 (*b*), the toner particles adhere well on the portions A and B in the figure, while toner particles do not adhere very well on the intermediate portion because the electric field does not leak to the gap, and it is not possible to perform the development with high fidelity on the accumulated electric charge.

Then, short-circuiting is performed across the power source E between the photosensitive member 101 and the electrostatic information recording medium 103 as shown in FIG. 1 (*c*). Because the photosensitive member 101 and the electrostatic information recording medium 103 are placed face-to-face with a gap of about 10 μm, the lines of electric force by the accumulated electric charge are also generated toward the electrode of the photosensitive member 101, and the electric field by the accumulated electric charge leaks into the gap. By immersing the photosensitive member and the electrostatic information recording medium into the container 105 filled with the toner 107, the accumulated electric charge and the negative (−) toner are combined together, and development can be performed. Also, the development may be made, instead of by short-circuiting across the power source E between the photosensitive member and 101 the electrostatic information recording medium 103 but by providing a development electrode at the position face-to-face to the electrostatic information recording medium 103 and by short-circuiting (across the power source E) this electrode and the electrode of the electrostatic information recording medium.

Figure 2:
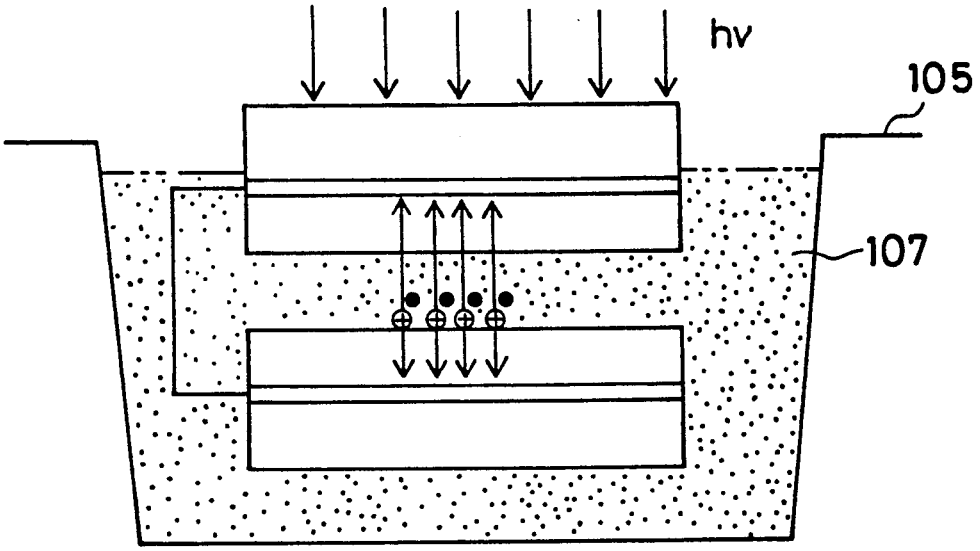
FIG. 2 is an example to increase the electric conductivity of the photoconductive layer by blanket exposure from the direction of the photosensitive member.

In FIG. 2, blanket exposure is performed from the direction of the photosensitive member 101 under the condition of FIG. 1 (*c*) and change carriers are generated on the portion of the photoconductive layer where the electric field is formed by the accumulated electric charge on the electrostatic information recording medium 103. Thus, the conductivity is increased and the electric field leaks more to the gap. In so doing, the toner concentration in the development can be increased.

Figure 3:
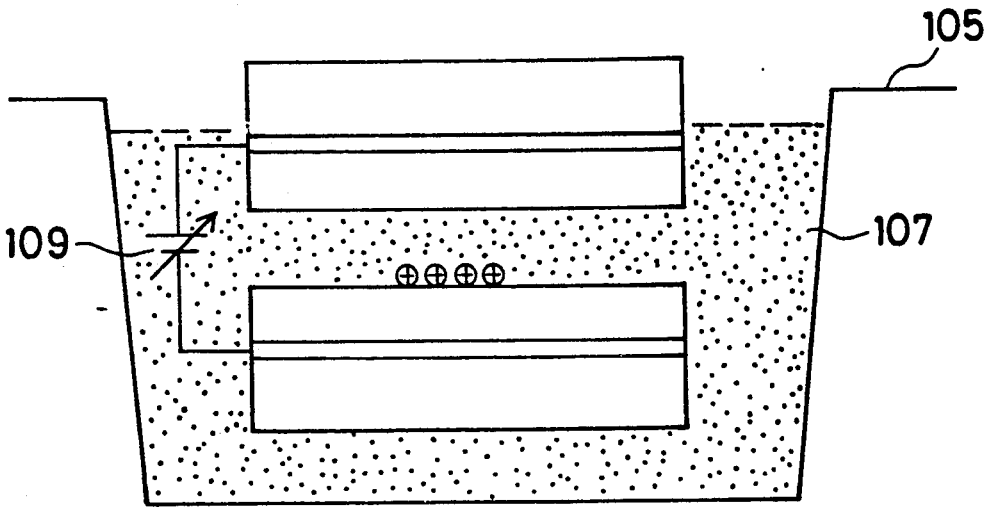
FIG. 3 is an example to perform toner development by applying a bias voltage between the photosensitive member and the electrostatic information recording medium.
Figure 4:
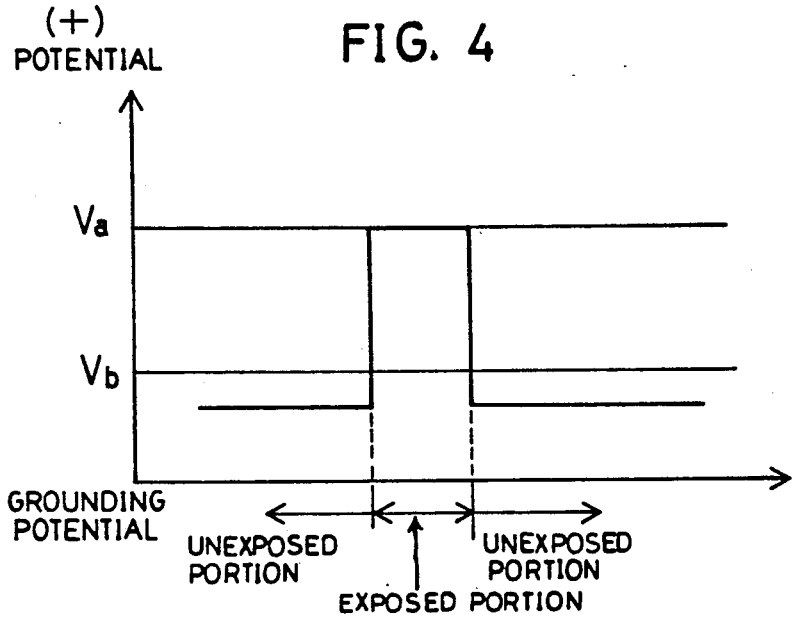
FIG. 4 is a diagram to show the distribution of the potential on the electrostatic information recording medium.

FIG. 3 represents another embodiment of this invention, and FIG. 4 is a diagram to explain the method for applying a bias voltage in the embodiment of FIG. 3.

In FIG. 3, bias voltage is applied between the photosensitive member 101 and the electrostatic information recording medium 103 with a positive change (+) on the photosensitive member and a negative change (−) on the electrostatic information recording medium 103 after image exposure is performed as given in FIG. 1.

By the image exposure, the predetermined potential is generated on the exposed and the unexposed portions of the electrostatic information recording medium 103 as shown in FIG. 4. The potential on the unexposed portion is the so-called fogging potential. When electric field is generated in the gap between the photosensitive member and the electrostatic information recording medium, corona discharge occurs, and it is accumulated on the electrostatic information recording medium as background. If bias voltage is set as given by Vb in the figure, the influence by the fogging potential disappears. When it is developed by (−) toner, only the exposed portion is developed by the toner, and sharp negative image can be obtained.

If bias voltage is set to the maximum value of the potential on the exposed portion as given by Va in FIG. 4, there is no difference of the potential from the exposed portion, and the difference of the potential from the unexposed portion is increased. When (+) toner is used, toner is attached on the unexposed portion, and positive image can be obtained.

As described above, by applying bias voltage between the photosensitive member and the electrostatic information recording medium and by setting this value approximately to the fogging potential, sharp negative image without background can be obtained. By setting the bias voltage to the maximum potential on the exposed portion and by performing development using the toner with the same polarity as the accumulated electric charge at the exposure, the positive image can be obtained.

When (+) electric charge image is formed on the electrostatic information recording medium, the relation between bias condition and the toner image to the toner polarity is as shown in Table 1 if the fogging potential is supposed to be Vk.

TABLE 1

| Bias condition | [(+) electric charge on the medium] (+) toner | (−) toner |
|---|---|---|
| V < Vk | x | Negative image Background greasing |
| V = Vk | x | Negative image No background greasing High density |
| Vk < V < Vk | Positive image No background greasing Medium density | Negative image No background greasing Medium density |
| V = Va | Positive image High density | x |
| V > Va | Positive image Background greasing | x |

x . . . Development not achievable
Negative image . . . Exposed portion developed
Positive image . . . Unexposed portion developed In FIG. 3, electric charge is accumulated on the electrostatic information recording medium. Actually, the electric charge with the polarity reverse to the electric charge on the electrostatic information recording medium is accumulated on the surface of the photosensitive member.

Figure 5:
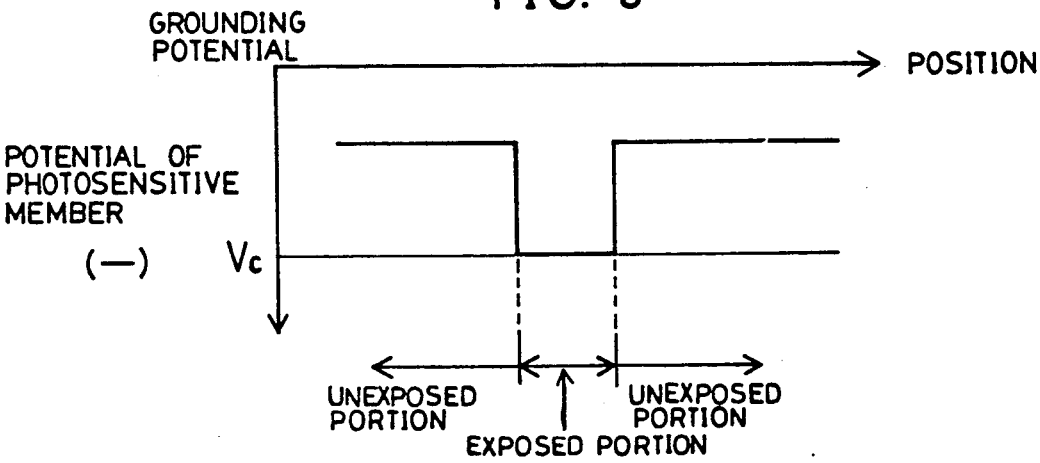
FIG. 5 is a diagram to show the distribution of the potential on the photosensitive member.

FIG. 5 shows the distribution of the potential on the surface of this photosensitive member. The potential on the exposed portion and the potential on unexposed portion are in the reverse relation to that of the electrostatic information recording medium. When the bias potential is set to the potential Vc of the exposed portion as shown in FIG. 5 and the surface of the photosensitive member is developed by (+) toner, positive image can be obtained. On the contrary, if it is set to the maximum potential of the unexposed portion, negative image can be obtained by toner development.

The relation of toner image to the bias condition and toner image to toner polarity on the photosensitive member by the bias polarity of FIG. 3 is as summarized in Table 2.

TABLE 2

| Bias condition | [(−) electric charge on photosensitive member] (+) toner | (−) toner |
|---|---|---|
| −V < Vk | Negative image Background greasing | x |
| −V = Vk | Negative image No background greasing High density | x |
| Vk < −V < Vc | Negative image No background greasing Medium density | Positive image No background greasing Medium density |
| −V = Vc | x | Positive image No background greasing High density |
| −V > Vc | x | Positive image Background greasing |

TABLE 2-continued

| Bias condition | [(−) electric charge on photosensitive member] (+) toner | (−) toner |
|---|---|---|
| | | |

Suppose that the film thickness and dielectric constant of the photosensitive layer and the electrostatic information recording medium are $d_p$, $d_i$, $\epsilon_p$ and $\epsilon_i$ respectively. If $\epsilon_p/d_p=\epsilon_i/d_i$, then va=vc.

Suppose that the voltage and the electrostatic capacity on the photosensitive layer are $V_1$ and $C_1$, that the voltage and the electrostatic capacity on the gap between the photosensitive member and the electrostatic information recording medium are $V_G$ and $C_G$, and that the voltage and the electrostatic capacity on the electrostatic information recording medium are $V_2$ and $C_2$ respectively.

Then, $$\frac{1}{C} = \frac{1}{C_1} + \frac{1}{C_G} + \frac{1}{C_2} = \frac{C_GC_2 + C_1C_2 + C_1C_G}{C_1C_GC_2}$$

Therefore, $$C = \frac{C_1C_GC_2}{C_GC_2 + C_1C_2 + C_1C_G}$$

Because $$Q = CE = \frac{C_1C_GC_2}{C_GC_2 + C_1C_2 + C_1C_G} \cdot E$$

$$V_1 = \frac{Q}{C_1} = \frac{C_GC_2}{C_GC_2 + C_1C_2 + C_1C_G} \cdot E$$

$$V_2 = \frac{Q}{C_2} = \frac{C_1C_G}{C_GC_2 + C_1C_2 + C_1C_G} \cdot E$$

$V_G$ is obtained as follows:

$$\begin{aligned} V_G &= E - V_1 - V_2 \\ &= \frac{C_GC_2 + C_1C_2 + C_1C_G - C_GC_2 - C_1C_G}{C_GC_2 + C_1C_G + C_1C_G} \cdot E \\ &= \frac{C_1C_2}{C_GC_2 + C_1C_2 + C_1C_G} \cdot E \end{aligned}$$

Bias voltage V is given by $V_G$. However, $C_G$ is determined by the gap size $d_G$ and by the dielectric constant $\epsilon_G$ of the developing solution filled in the gap.

In case the voltage applied during exposure is of reverse polarity to the case of FIG. 3, the relation of the bias voltage to the electrostatic information recording medium and the photosensitive member with the toner image to the toner polarity is as summarized in Table 3 and Table 4.

TABLE 3

| Bias condition | [(−) electric charge on the medium] (+) toner | (−) toner |
|---|---|---|
| −V < Vk | Negative image Background greasing | x |
| −V = Vk | Negative image No background greasing High density | x |
| Vk < −V < Va | Negative image No background greasing | Positive image No background greasing |

TABLE 3-continued

| [(−) electric charge on the medium] | | |
|---|---|---|
| Bias condition | (+) toner | (−) toner |
| | Medium density | Medium density |
| −V = Va | x | Positive image No background greasing High density |
| −V > Va | x | Positive image Background greasing |

TABLE 4

| [(+) electric charge on the photosensitive member] | | |
|---|---|---|
| Bias condition | (+) toner | (−) toner |
| V < Vk | x | Negative image Background greasing |
| V = Vk | x | Negative image No background greasing High density |
| Vk < V < Vc | Positive image No background greasing Medium density | Negative image No background greasing Medium density |
| = Vc | Positive image High density | x |
| V > Vc | Positive image Background greasing | x |

Next, description will be given on the examples, in which color image can be observed from the positive image on the surface of the photosensitive member in connection with FIG. 6 and FIG. 7.

Figure 6A:
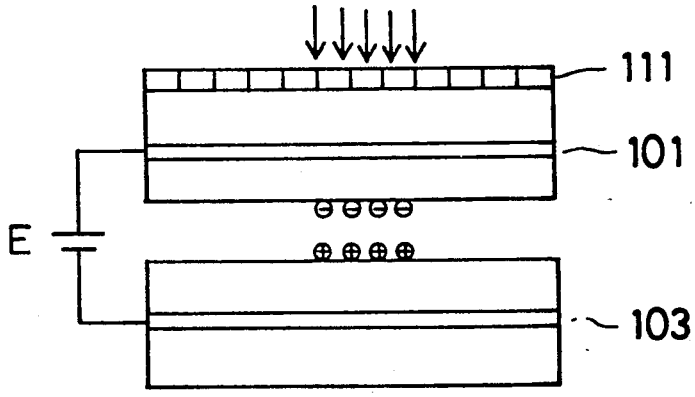
FIG. 6(*a* and *b*) and FIG. 7 are the schematical drawings of the examples to form color images on the photosensitive member.
Figure 6B:
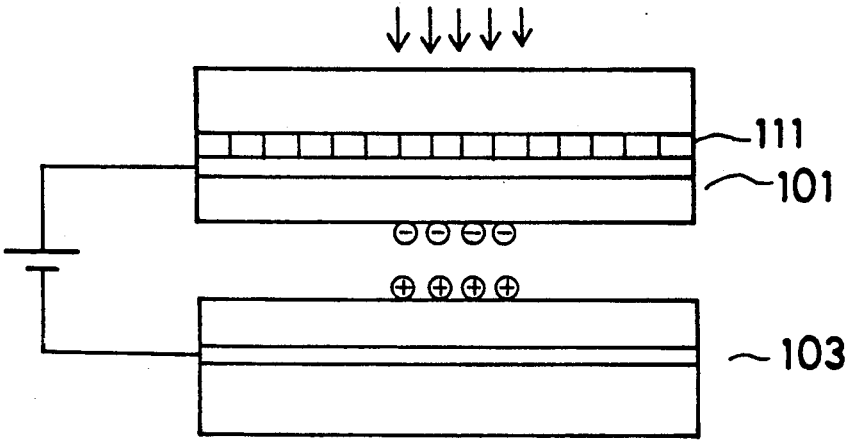

FIGS. 6 (*a*) and (*b*) represent an embodiment, where exposure is performed using color filter. FIG. 7 shows the toner development in the exposure by red (R) light. In these figures, 111 refers to a color filter, and 113 toner.

In FIG. 6 (*a*), a color filter 111 is furnished on the surface of the support member of the photosensitive member, and the color filter 111 may be any type such as stripe color filter, mosaic color filter, random type color filter, R-G-S filter, C-M-Y complementary color filter, etc. When exposure is performed through the color filter 111, (+) electric charge is accumulated on the electrostatic information recording medium, and (−) electric charge on the surface of the photosensitive member, which is placed face-to-face to the former.

Figure 7:
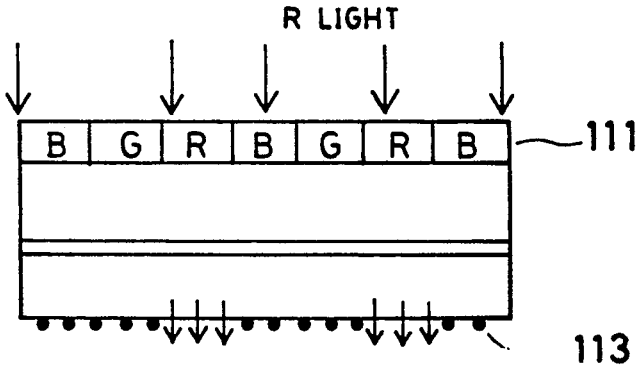

After blanket R light is irradiated to the color filter 111 as shown in FIG. 7, for instance, bias voltage Vc approximately equal to the potential of the exposed portion as given in FIG. 5 is applied, and toner development is performed by (−) toner. Then, the potential on the photoconductive layer corresponding to R of the color filter is turned to zero, and the toner is not attached on it. Thus, R light is absorbed by the filter on the portions B and G, and these portions are left in unexposed state. Then, the predetermined potential is generated, and the toner 113 is attached on it.

Therefore, if white light is irradiated on it and the image is observed through the color filter, light is shut off on the portions B and G, and light is transmitted only on the portion R. Thus, red image can be seen. In this way, if R light is irradiated, red color can be observed under white light as the result of toner development. Because the same applies to the cases of B and G, it is possible to form color image by single-acting operation through the irradiation of optical image containing R, G and B.

In case the color filter is formed on the surface of the support member as shown in FIG. 6 (*a*), color deviation occurs due to parallax because the toner image after development is separated from the filter. If color filter is provided on the electrode of the photosensitive member as shown in FIG. 6 (*b*) to bring the filter closer to the toner image, the color deviation due to parallax can be reduced.

FIG. 8 shows an example, in which the image of FIG. 7 is formed on the electrostatic information recording medium, and 115 represents the color filter. In this embodiment, image exposure is performed from the direction of electrostatic information recording medium, and image is formed through the color filter 115. As in the case of FIG. 4, bias potential va is applied and toner development is performed by (+) toner, and positive image is obtained. As in FIG. 7, it is also possible to observe the color image through the color filter 115. As the filter 115 the insulating color filter may be used, or an insulating layer 117 may be coated on the color filter 115 as in FIG. 9 (*a*).

Figure 9A:
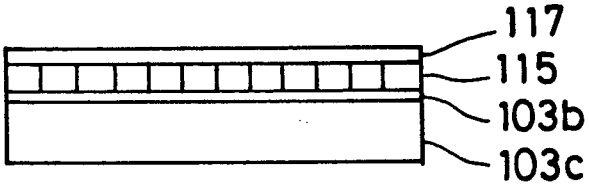
Figure 9B:
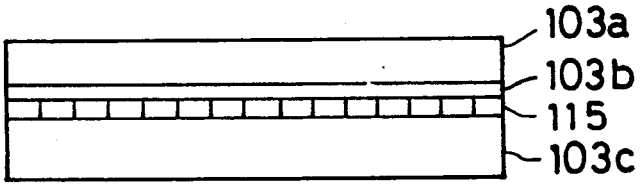
Figure 9C:
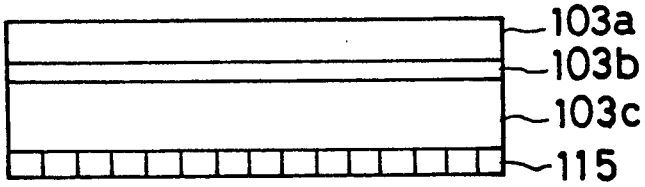

In FIG. 9 (*a*), the insulating layer 103*a* of the electrostatic information recording medium is omitted, and it is replaced by the color filter 115 and the coating layer 117. With this arrangement, exposure is performed from the direction of the electrostatic information recording medium as in FIG. 8. Through toner development by applying bias voltage as in FIG. 7, color image can be observed.

The color filter may be provided on the electrode as in FIG. 9 (*b*) or on the surface of the support member as in FIG. 9 (*c*). In this case, it is more advantageous than FIG. 9 (*a*) because there is no need to take special care on the electric charge carrying property of the color filter itself. Also, as in FIG. 6 (*b*), color deviation due to parallax can be minimized because the filter is brought closer to the toner image after development in the cases of FIGS. 9 (*a*) and (*b*).

In the above description, the photosensitive member and the electrostatic information recording medium are placed face-to-face, and image exposure is performed, and these are immersed in the toner for toner development. However, image exposure may be performed with the photosensitive member and the electrostatic information recording medium immersed in the toner. In this case, corona discharge does not occur between the photosensitive member and the electrostatic information recording medium, and toner particles are attached through electrophoresis.

As described above, it is possible by this invention to obtain the negative image and the positive image at the same time on the surface of the electrostatic information recording medium and the photosensitive member. Also, when color image is formed by single-acting operation, it is possible to eliminate color deviation because the color filter is integrated with the electrostatic information recording medium and the photosensitive member.

What we claim is:

1. A method for toner development of an electrostatic latent image, comprising the steps of:

providing a photosensitive member consisting of a photoconductive layer formed on a transparent electrode and a transparent support member supporting said transparent electrode;

providing an electrostatic information recording medium consisting of an insulating layer formed on a support member with a conductive layer therebetween;

placing said photosensitive member face-to-face with said electrostatic information recording medium with a predetermined gap therebetween;

applying a voltage between the conductive layers of said photosensitive member and said electrostatic information recording medium;

performing image exposure through said transparent support member, said transparent electrode, and said photosensitive member onto said electrostatic information recording medium to accumulate electric charge in the shape of an image on a surface of said electrostatic information recording medium;

removing the voltage applied between the conductive layers of said photosensitive member and said electrostatic information recording medium and electrically connecting said photosensitive member and said electrostatic information recording medium; immersing at least the surfaces of said electrostatic information recording medium and said photosensitive member in the toner; and performing toner development on the immersed surfaces of said electrostatic information recording medium and/or said photosensitive member.

2. A method for toner development as set forth in claim 1, wherein blanket exposure is performed after immersing the electrostatic information recording medium and the photosensitive member in the toner.

3. A method for toner development of an electrostatic latent image, comprising the steps of:

providing a photosensitive member consisting of a photoconductive layer formed on a transparent electrode and a transparent support member supporting said transparent electrode;

providing an electrostatic information recording medium consisting of an insulating layer formed on a support member with a conductive layer therebetween;

placing said photosensitive member face-to-face with said electrostatic information recording medium with a predetermined gap therebetween;

applying a voltage between the conductive layers of said photosensitive member and said electrostatic information recording medium;

performing image exposure through said transparent support member, said transparent electrode, and said photosensitive member onto said electrostatic information recording medium to accumulate electric charge in the shape of an image on a surface of said electrostatic information recording medium;

applying a bias voltage between the conductive layers of said photosensitive member and said electrostatic information recording medium; and immersing at least the surfaces of said electrostatic information recording medium and said photosensitive member in the toner.

4. A method for toner development as set forth in claim 3, wherein said bias voltage is set to higher than the potential of the unexposed portion and lower than the maximum potential of the exposed portion of said electrostatic information recording medium, and a positive or a negative image is formed on said electrostatic information recording medium and/or said photosensitive member.

5. A method for toner development as set forth in claim 3, wherein said bias voltage is set to higher than the potential of the unexposed portion and lower than the maximum potential of the exposed portion on the photosensitive member, and a positive or a negative image is formed on said electrostatic information recording medium and/or said photosensitive member.

6. A method for toner development as set forth in one of claims 1, 3, 4, or 5, wherein after said step of providing a photosensitive member, and before said step of providing said electrostatic information recording medium, laminating a color filter on said photosensitive member, and wherein in said step of exposing the image, performing the image exposure through said color filter.

* * * * *